US010982538B2

(12) United States Patent
Tiwari et al.

(10) Patent No.: US 10,982,538 B2
(45) Date of Patent: Apr. 20, 2021

(54) MULTI-ZONE WELL TESTING

(71) Applicant: Saudi Arabian Oil Company, Dhahran (SA)

(72) Inventors: Shrikant Tiwari, Dhahran (SA); Prasad Karunakaran, Dharhan (SA)

(73) Assignee: Saudi Arabian Oil Company, Dhahran (SA)

( * ) Notice: Subject to any disclaimer, the term of this patent is extended or adjusted under 35 U.S.C. 154(b) by 224 days.

(21) Appl. No.: 15/924,737

(22) Filed: Mar. 19, 2018

(65) Prior Publication Data

US 2019/0284933 A1 Sep. 19, 2019

(51) Int. Cl.
*E21B 49/08* (2006.01)
*E21B 34/06* (2006.01)
*E21B 33/124* (2006.01)

(52) U.S. Cl.
CPC ..... *E21B 49/088* (2013.01); *E21B 33/124* (2013.01); *E21B 34/06* (2013.01); *E21B 49/087* (2013.01)

(58) Field of Classification Search
CPC ..... E21B 33/124; E21B 34/06; E21B 49/087; E21B 49/088
See application file for complete search history.

(56) References Cited

U.S. PATENT DOCUMENTS 3,762,219 A * 10/1973 Jessup ..... E21B 34/063 73/152.23
4,484,632 A * 11/1984 Vann ..... E21B 43/116 166/297
6,491,104 B1 * 12/2002 Wilie ..... E21B 33/124 166/336
6,622,554 B2 9/2003 Manke et al.
7,004,252 B2 2/2006 Vise, Jr.
8,776,591 B2 7/2014 Le Foll et al.
8,991,492 B2 3/2015 Lovell et al.
(Continued)

FOREIGN PATENT DOCUMENTS

GB 2448632 10/2008

OTHER PUBLICATIONS

Metrol, "Dual Zone Single Trip Drill Step Tests: Save Rig Time," Case Study 1001/01, Metrol Applied Intelligence, Feb. 2014, 7 pages.
(Continued)

*Primary Examiner* — Caroline N Butcher
(74) *Attorney, Agent, or Firm* — Fish & Richardson P.C.

(57) ABSTRACT

A downhole testing assembly includes a cylindrical body with a central bore extending between a first, uphole end of the cylindrical body and a second, downhole end opposite the first, uphole end of the cylindrical body; an open hole packer to engage and seal against an open hole surface of the wellbore to define a first open-hole zone of the wellbore downhole of the open hole packer; a first cased hole packer to engage and seal against a first portion of a casing of the wellbore to define a second open-hole zone of the wellbore between the first cased hole packer and the open hole packer; and a second cased hole packer to engage and seal against a second portion of the casing uphole of the first portion to define a cased zone of the wellbore between the second cased hole packer and the first cased hole packer.

32 Claims, 9 Drawing Sheets

(56) References Cited

U.S. PATENT DOCUMENTS

| | | | | |
|---|---|---|---|---|
| 2001/0050170 | A1* | 12/2001 | Woie | E21B 41/0057 166/252.1 |
| 2009/0288824 | A1* | 11/2009 | Fowler, Jr. | E21B 33/124 166/250.17 |
| 2011/0048122 | A1 | 3/2011 | Pierre et al. | |
| 2013/0118732 | A1* | 5/2013 | Chauffe | E21B 34/06 166/250.04 |
| 2015/0068772 | A1* | 3/2015 | Richards | E21B 47/092 166/386 |
| 2015/0240598 | A1 | 8/2015 | Zhou | |
| 2018/0073335 | A1* | 3/2018 | Patel | E21B 23/02 |
| 2018/0266225 | A1* | 9/2018 | Kemick | E21B 43/261 |

OTHER PUBLICATIONS

International Search Report and Written Opinion issued in International Application No. PCT/US2019/021320 dated May 22, 2019, 14 pages.

* cited by examiner

MULTI-ZONE WELL TESTING

TECHNICAL FIELD

This disclosure relates to multi-zone well testing with a downhole testing assembly, for example, in an open hole or cased hole portion of a wellbore.

BACKGROUND

Well testing is a process for the exploration and evaluation of reservoir potential for planning of hydrocarbon field development. Exploratory hydrocarbon wells are drilled to find new hydrocarbon plays in new areas, for example, after seismic and geological surveys of hydrocarbon presence. Well testing assesses hydrocarbon potential of a well, and includes directing formation fluid to surface through the well for conclusive measurements and evaluation. Drill stem tests (DST) are widely used as a method for reserve assessment, and include cased hole DST, bare foot DST, or open hole DST. Well testing can provide a wide range of reservoir information, such as well productivity, permeability, pressure, formation damage, drainage area, and other well characteristics.

SUMMARY

This disclosure describes a testing assembly and process for testing multiple zones in a well by isolating and individually testing each zone using the testing assembly.

In an example implementation, a downhole testing assembly includes a cylindrical body configured to be disposed in a wellbore extending into a formation, the cylindrical body including a central bore extending between a first, uphole end of the cylindrical body and a second, downhole end opposite the first, uphole end of the cylindrical body; an open hole packer that circumscribes the cylindrical body, the open hole packer configured to engage and seal against an open hole surface of the wellbore to define a first open-hole zone of the wellbore downhole of the open hole packer; a first cased hole packer that circumscribes the cylindrical body uphole of the open hole packer, the first cased hole packer configured to engage and seal against a first portion of a casing of the wellbore to define a second open-hole zone of the wellbore between the first cased hole packer and the open hole packer; and a second cased hole packer that circumscribes the cylindrical body, the second cased hole packer configured to engage and seal against a second portion of the casing uphole of the first portion to define a cased zone of the wellbore between the second cased hole packer and the first cased hole packer.

An aspect combinable with the example implementation further includes a sleeve valve in the cylindrical body positioned between the second cased hole packer and the first cased hole packer.

In another aspect combinable with any of the previous aspects, the sleeve valve is configured to selectively open a circulation port that fluidly connects well fluid in the cased zone with the central bore of the cylindrical body.

In another aspect combinable with any of the previous aspects, the second cased hole packer is positioned uphole of a perforated zone of the casing.

In another aspect combinable with any of the previous aspects, the open hole packer is positioned proximate to the downhole end of the cylindrical body.

In another aspect combinable with any of the previous aspects, the first cased hole packer is positioned proximate to a downhole end of the casing.

In another aspect combinable with any of the previous aspects, the second cased hole packer is positioned uphole of the first cased hole packer.

In another aspect combinable with any of the previous aspects, the open hole packer includes a first hydraulic packer, the first hydraulic packer configured to activate in response to a pressure in the central bore greater than a first threshold pressure.

In another aspect combinable with any of the previous aspects, the first cased hole packer includes a second hydraulic packer, the second hydraulic packer configured to activate in response to a pressure in the central bore greater than a second threshold pressure greater than or equal to the first threshold pressure.

In another aspect combinable with any of the previous aspects, the second cased hole packer is configured to activate in response to rotation of the cylindrical body.

In another aspect combinable with any of the previous aspects, the second cased hole packer includes a mechanical packer.

Another aspect combinable with any of the previous aspects further includes a release joint in the cylindrical body between the first cased hole packer and the open hole packer.

In another aspect combinable with any of the previous aspects, the release joint is configured to disconnect the cylindrical body at the release joint.

Another aspect combinable with any of the previous aspects further includes a first seal structure positioned between the open hole packer and the first cased hole packer.

In another aspect combinable with any of the previous aspects, the first seal structure is configured to selectively engage with a first plug element and isolate the central bore from well fluid from the first open-hole zone.

Another aspect combinable with any of the previous aspects further includes a second seal structure positioned between the first cased hole packer and the second cased hole packer.

In another aspect combinable with any of the previous aspects, the second seal structure is configured to selectively engage with a second plug element and isolate the central bore from well fluid from at least one of the second open-hole zone and the first open-hole zone.

In another example implementation, a method for testing fluid in a wellbore includes running a downhole testing assembly into a wellbore; engaging, with an open hole packer of the downhole testing assembly, an open hole surface of the wellbore downhole of a casing of the wellbore; engaging, with a first cased hole packer of the downhole testing assembly, a first portion of the casing; engaging, with a second cased hole packer of the downhole testing assembly, a second portion of the casing uphole of the first portion of the casing; flowing a first fluid from a first open-hole zone downhole of the open hole packer through a central bore of the downhole testing assembly to test the first fluid from the first open-hole zone; flowing a second fluid from a second open-hole zone between the first cased hole packer and the open hole packer through the central bore of the downhole testing assembly to test the second fluid from the second open-hole zone; and flowing a third fluid from a third, cased zone between the first cased hole packer and the second cased hole packer through the central bore of the downhole testing assembly to test the third fluid from the third, cased zone.

In an aspect combinable with the example implementation, the first cased hole packer engaged with the first portion of the casing of the wellbore is proximate to a downhole end of the casing.

In another aspect combinable with any of the previous aspects, the first cased hole packer is positioned adjacent to a casing shoe of the casing.

In another aspect combinable with any of the previous aspects, the second cased hole packer engaged with the second portion of the casing of the wellbore is positioned uphole of a perforated zone of the casing.

In another aspect combinable with any of the previous aspects, the wellbore extends into a formation, and the open hole packer engaged with the open hole surface of the wellbore is positioned between a first zone of interest and a second zone of interest of the formation.

In another aspect combinable with any of the previous aspects, engaging the open hole surface of the wellbore downhole of the casing with the open hole packer includes sealing the open hole packer to the open hole surface.

In another aspect combinable with any of the previous aspects, engaging the open hole surface of the wellbore downhole of the casing with the open hole packer includes: sealingly engaging a plug on a plug seat within the central bore of the downhole testing assembly and expanding the open hole packer to engage the open hole surface in response to a first, lower threshold pressure within the central bore.

In another aspect combinable with any of the previous aspects, engaging the first portion of the casing of the wellbore with the first cased hole packer includes expanding the first cased hole packer to engage the first portion of the casing in response to a second, higher threshold pressure within the central bore.

Another aspect combinable with any of the previous aspects further includes subsequent to flowing the first fluid from the first open-hole zone through the central bore of the downhole testing assembly and prior to flowing the second fluid from the second open-hole zone through the central bore, sealingly engaging, with a plug element, a first sealing assembly positioned uphole of the open hole packer to isolate the central bore from the first fluid of the first open-hole zone.

In another aspect combinable with any of the previous aspects, the plug element includes at least one of a plug or a prong, and the sealing assembly includes a plug seat.

In another aspect combinable with any of the previous aspects, flowing the second fluid from the second open-hole zone through the central bore includes flowing the second fluid from the second open-hole zone through at least one perforation in a wall of the downhole testing assembly within the second open-hole zone and into the central bore.

Another aspect combinable with any of the previous aspects further includes perforating, with a perforation gun on a wireline disposed within the central bore of the downhole testing assembly, the wall of the downhole testing assembly to form the at least one perforation prior to flowing the second fluid from the second open-hole zone through the central bore.

Another aspect combinable with any of the previous aspects further includes, in response to flowing the second fluid from the second open-hole zone through the central bore and prior to flowing the third fluid from the third, cased zone through the central bore, sealingly engaging, with a plug element, a second sealing assembly positioned proximate to the first cased hole packer to isolate the central bore from the second fluid of the second open-hole zone and the first fluid of the first open-hole zone.

In another aspect combinable with any of the previous aspects, flowing the third fluid from the third, cased zone between the first cased hole packer and the second cased hole packer through the central bore of the downhole testing assembly includes moving a sleeve valve of the downhole testing assembly from a first, closed position to a second, open position and flowing the third fluid from the third, cased zone through a circulation port of the sleeve valve with the sleeve valve in the second, open position and through the central bore of the downhole testing assembly.

Another aspect combinable with any of the previous aspects further includes retrieving, with a slick line disposed in the wellbore, the downhole testing assembly.

In another aspect combinable with any of the previous aspects, retrieving the downhole testing assembly includes moving the testing assembly uphole to unset the first cased hole packer and the second cased hole packer.

In another aspect combinable with any of the previous aspects, retrieving the downhole testing assembly further includes moving the testing assembly uphole to unset the open hole packer.

In another aspect combinable with any of the previous aspects, retrieving the downhole testing assembly further includes abandoning the open hole packer in the wellbore Implementations described in the present disclosure may include some, none, or all of the following features. For example, implementations may test multiple zones of a wellbore, including one or more open hole zones, one or more cased hole zones, or both open hole and cased hole zones, in a single run of a testing assembly. For example, implementations may combine beneficial attributes of many drill stem techniques into a single drill stem testing assembly run, including cased hole drill stem testing, bare foot drill stem testing, and open hole drill stem testing. Implementations may provide a cost savings and a reduction in wellbore testing time. The process out lined in this disclosure can be implemented in various well construction scenario with suitable variations in testing assembly components. Implementation of the process would reduce the total well testing time, effectively reducing cost of operations.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

This disclosure describes a testing assembly, such as a drill stem test (DST) assembly, and a testing method for testing multiple zones in a well. The testing assembly includes both open hole and cased hole packers to isolate and test multiple sections of a wellbore, including one or more open hole portions, cased hole portion, or a combination of open hole portions and cased hole portions of the wellbore. Each section of the wellbore can be tested separately and independently to accurately assess each section, or zone, of the wellbore. In some examples, the multi-zone well includes two or more open hole sections of a wellbore and a cased hole section of the wellbore. The testing assembly can isolate and test each of these zones individually or in groups of two or more zones with a single run in of the testing assembly. In example embodiments, the multi-zone testing assembly can test multiple zones of a wellbore, including cased zones, open hole zones, or a combination, without requiring multiple run-ins of the testing assembly. The testing assembly, in example embodiments, combines beneficial attributes of a cased hole drill stem testing assembly, an open hole testing assembly, and a barefoot testing assembly to test a multi-zone well with a single testing assembly and a single run-in.

Figure 1:
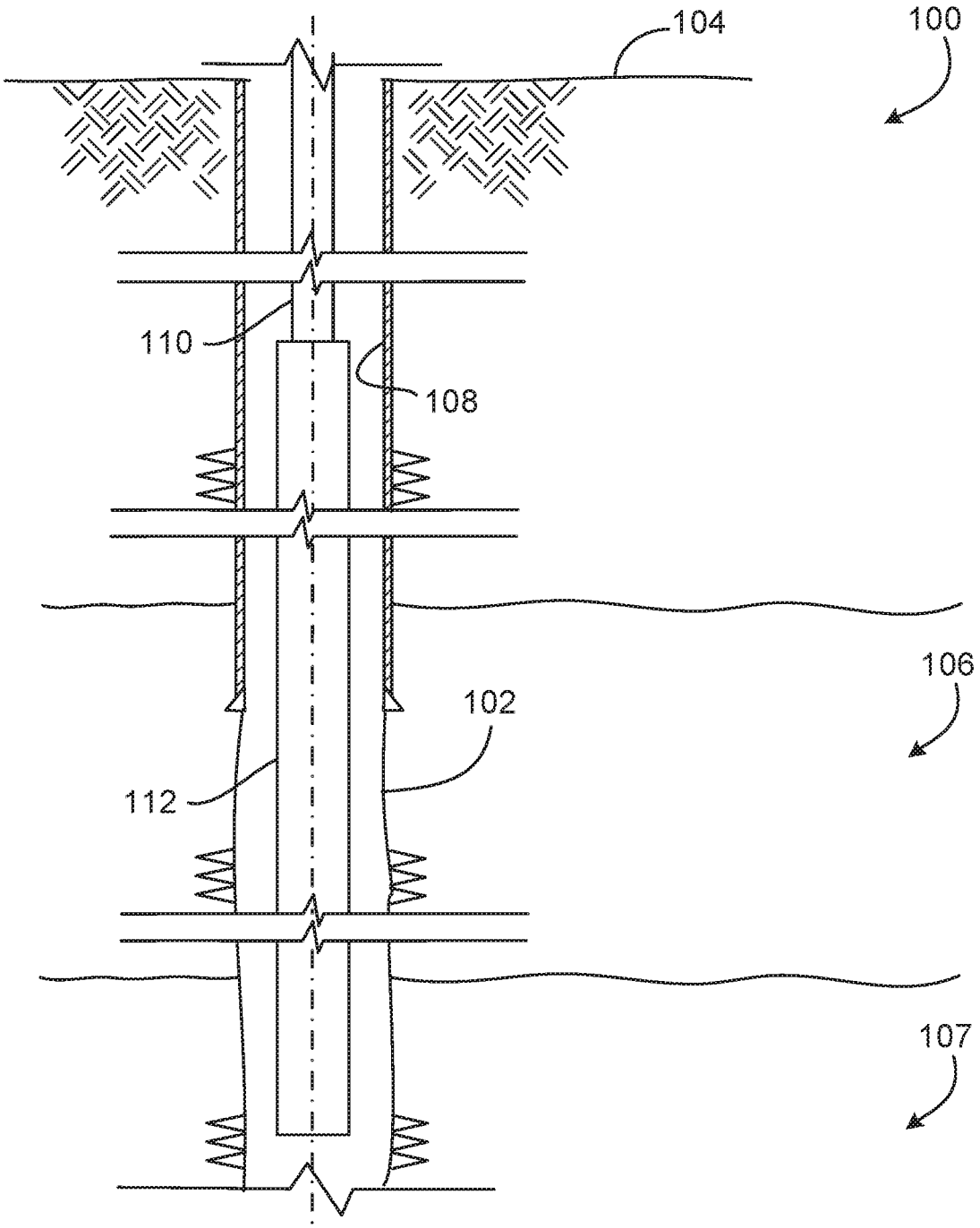
FIG. 1 is a schematic partial cross-sectional side view of an example well system including a testing assembly.

FIG. 1 is a schematic partial cross-sectional side view of an example well system 100 that includes a substantially cylindrical wellbore 102 extending from a surface 104 downward into the Earth into one or more subterranean zones of interest. In the example well system, the one or more subterranean zones of interest include a first subterranean zone 106 and a second subterranean zone 107. The well system 100 includes a vertical well, with the wellbore 102 extending substantially vertically from the surface 104 to the first subterranean zone 106 and the second subterranean zone 107. The concepts herein, however, are applicable to many different configurations of wells, including vertical, horizontal, slanted, or otherwise deviated wells.

The well system 100 includes a liner or casing 108 defined by lengths of tubing lining a portion of the wellbore 102 extending from the surface 104 into the Earth. The casing 108 is shown as extending only partially down the wellbore 102 and into the subterranean zone 106, with a remainder of the wellbore 102 shown as open-hole (for example, without a liner or casing); however, the casing 108 can extend further into the wellbore 102 or end further uphole in the wellbore 102 than what is shown schematically in FIG. 1.

A well string 110 is shown as having been lowered from the surface 104 into the wellbore 102. In some instances, the well string 110 is a series of jointed lengths of tubing coupled end-to-end or a continuous (or, not jointed) coiled tubing. The well string 110 can make up a work string, production string, drill string, or other well string used during the lifetime of the well system 100. In the example well system 100 of FIG. 1, the well string 110 includes a testing assembly 112.

The testing assembly 112 is shown in FIG. 1 as extending to a bottommost, downhole end of the well string 110. However, the location of the testing assembly 112 can vary on the well string 110. For example, the testing assembly 112 can be positioned at an intermediate location between a top hole end and a bottom hole end of the well string 110, such as between the top hole end and the bottom hole end when the well string extends further downhole of the testing assembly 112. The well string 110 can further include a drilling assembly or other well tool on the well string 110 uphole of, downhole of, or both uphole of and downhole of the testing assembly 112.

Figure 2:
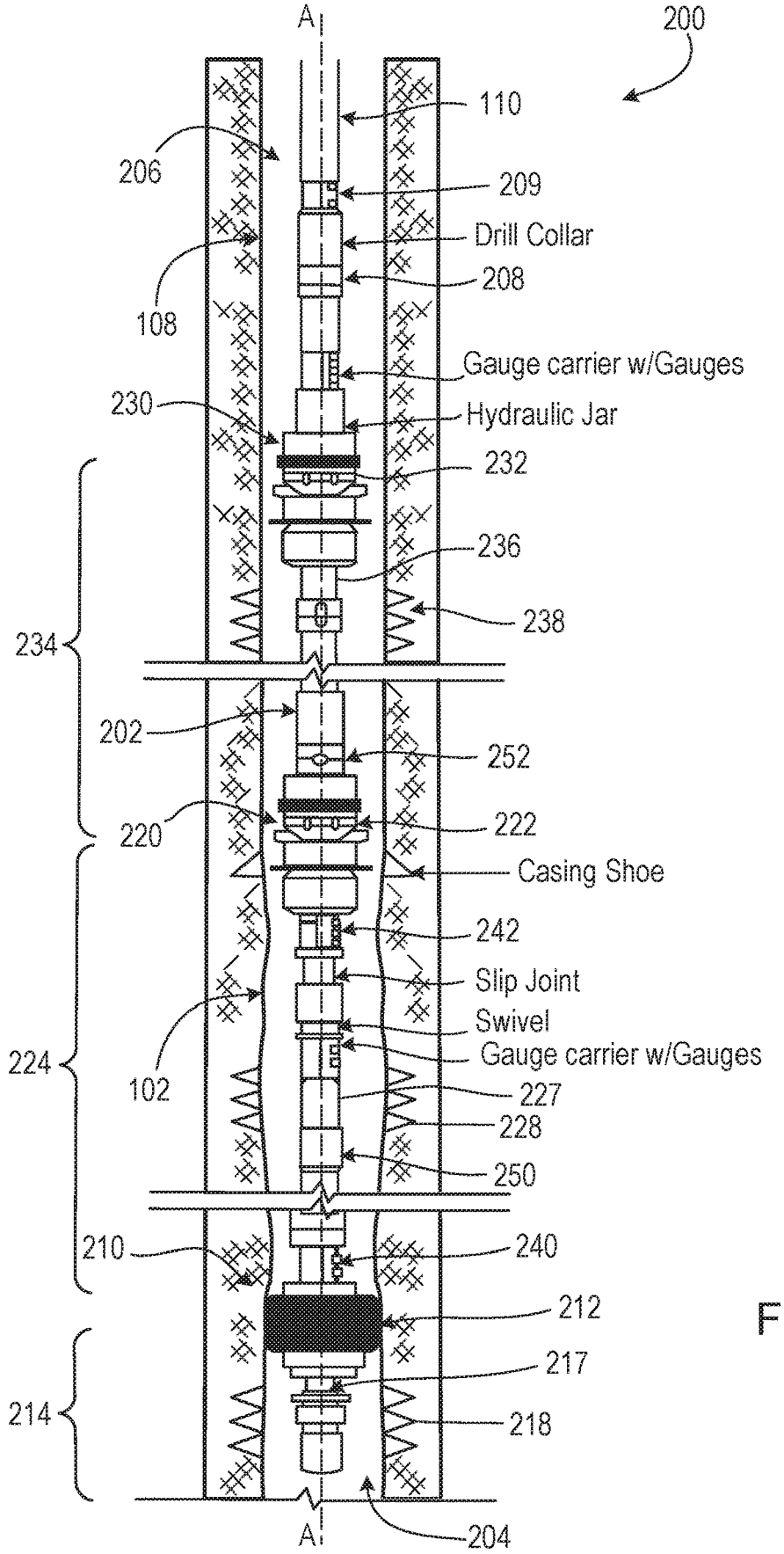
FIG. 2 is a schematic partial cross-sectional side view of an example testing assembly that can be used in the testing assembly of the well system of FIG. 1.
Figure 4:
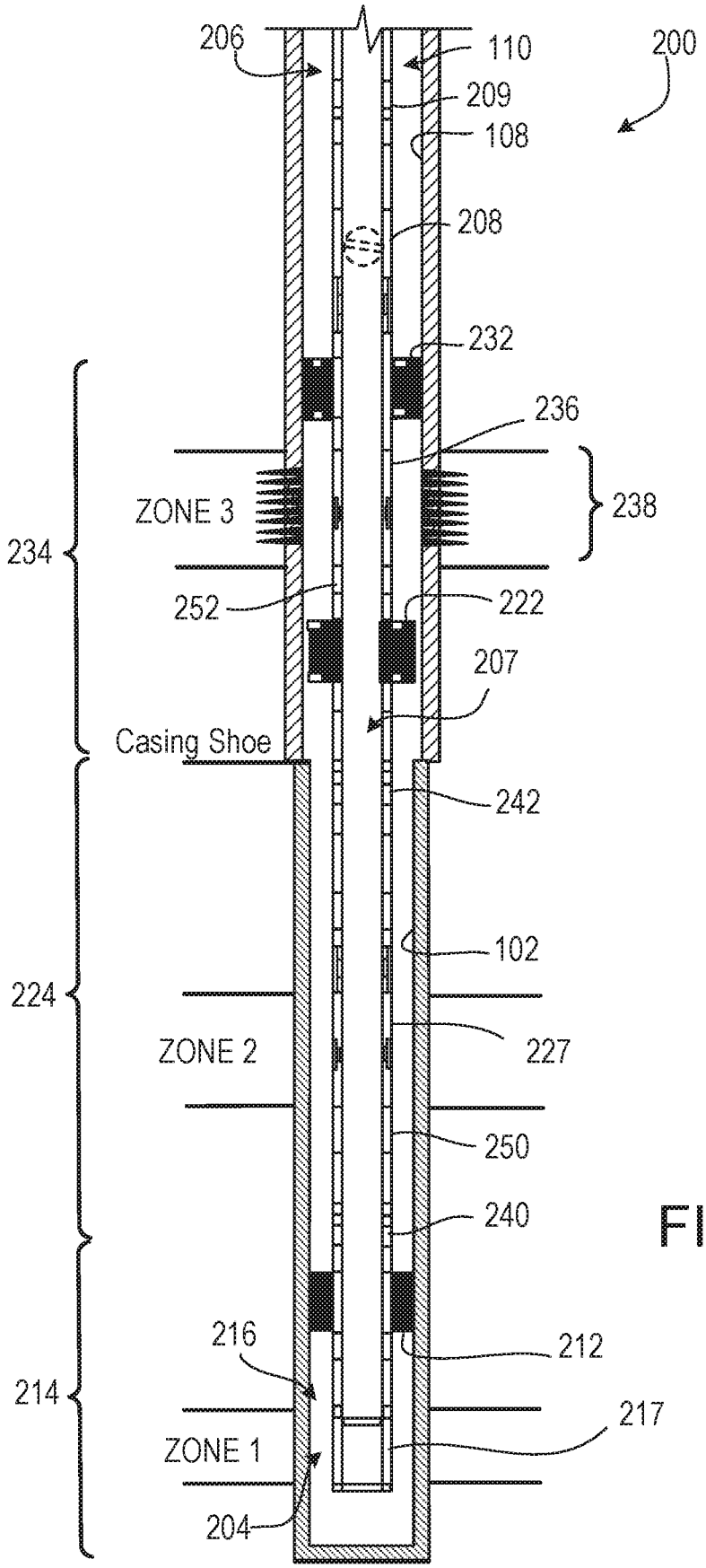
FIG. 4 is a cross sectional view of the testing assembly of FIG. 2.

FIG. 2 is a schematic partial cross-sectional side view of an example testing assembly 200 that can be used in the testing assembly 112 of the well system 100 of FIG. 1. FIG. 4 is a cross sectional view of the testing assembly 200 of FIG. 2. The example testing assembly 200 is shown in FIGS. 2 and 4, as positioned in the wellbore 102 on the well string 110, and includes a cylindrical body 202, for example, with a downhole end 204 positioned further downhole in the wellbore 102 than an uphole end 206 of the cylindrical body 202 opposite the downhole end 204. The body 202 is generally cylindrical, for example, to traverse the generally cylindrical wellbore 102. An internal fluid pathway 207, described in more detail later, extends through the body 202 from the downhole end 204 to the uphole end 206 to selectively flow fluid, such as well fluid from the wellbore 102, through the internal fluid pathway 207 in an uphole direction, in other words, in a direction from the downhole end 204 toward the uphole end 206.

A test valve 208 fluidly connected to the central bore can be cycled to open or closed position to allow the fluid in the central bore. The testing element 208 is positioned as part of the testing assembly 200, to be able to shut in the wells down hole or allow the flow through the testing assembly 200 to surface for further evaluation of flow parameters and fluid properties on surface. The tester valve 208 can take a variety of forms, operating hydraulically, mechanically, electronically or acoustically to cycle multiple times between open and close position during the well testing process.

Fluid testing and reservoir evaluation is carried out through a setup of flow lines and equipment on surface, which includes a choke manifold at a topside location of the wellbore 102, for example, at a surface level or above-ground location fluidly connected to the central bore, the wellbore 102, or both the central bore and the wellbore 102. The testing assembly 200 also includes a circulation valve 209, for example, to circulate fluid in the central bore, in the annulus of the wellbore 102, or both the central bore and the annulus.

The example testing assembly 200 includes an open hole sub-assembly 210 positioned in an open hole portion of the wellbore 102 downhole of the casing 108. The open hole sub-assembly 210 includes an open hole packer 212 that circumscribes the cylindrical body 202, for example, proximate the downhole end 204 of the cylindrical body 202. The open hole packer 212 engages and seals against an open hole surface of the wellbore 102 to define a first, lower open hole zone 214 of the wellbore 102 downhole of the open hole packer 212. The open hole packer 212 isolates fluid in the wellbore 102 downhole of the open hole packer from fluid in the wellbore 102 uphole of the open hole packer. The first open hole zone 214 of the wellbore 102 includes the area of the wellbore 102 downhole of the open hole packer 212.

The open hole packer 212 of the example testing assembly 200 of FIGS. 2 and 4 includes a hydraulic packer that activates (for example, actuates, swells, or otherwise radially expands) in response to a pressure in the central bore that is greater than a first threshold pressure. However, the open hole packer 212 can take other forms. For example, the open hole packer 212 can include a mechanical packer, hydraulic packer, swellable packer, or other packer type. In some implementations, the open hole sub-assembly 210 includes a sealing assembly 216 that engages with a sealing element to fluidly seal the central bore at the sealing assembly 216. The sealing assembly 216 fluidly seals the central bore, for example, to pressure-up the central bore to the first threshold pressure and activate the open hole packer 212. The sealing assembly 216 and sealing element can take a variety of forms. In some examples, the sealing assembly 216 includes a plug seat, ball seat, or other plug assembly, and the sealing element includes a plug, dropped ball, or other plug element that can interface with, sit on, or otherwise engage with the sealing assembly 216 to provide a pressure and fluid seal at the sealing assembly 216.

In some implementations, the testing assembly 200 includes a ball catcher 217, for example, to retain the sealing element 219 after it moves beyond the sealing assembly 216, or retain both the sealing element 219 and the sealing assembly 216 after the sealing assembly 216 is broken (for example, hydraulically blown). For example, the ball catcher 217 can retain a dropped ball or plug once the ball seat or plug seat is bypassed, for example, once the ball seat or plug seat is blown from an increase in pressure in the central bore.

Figure 7:
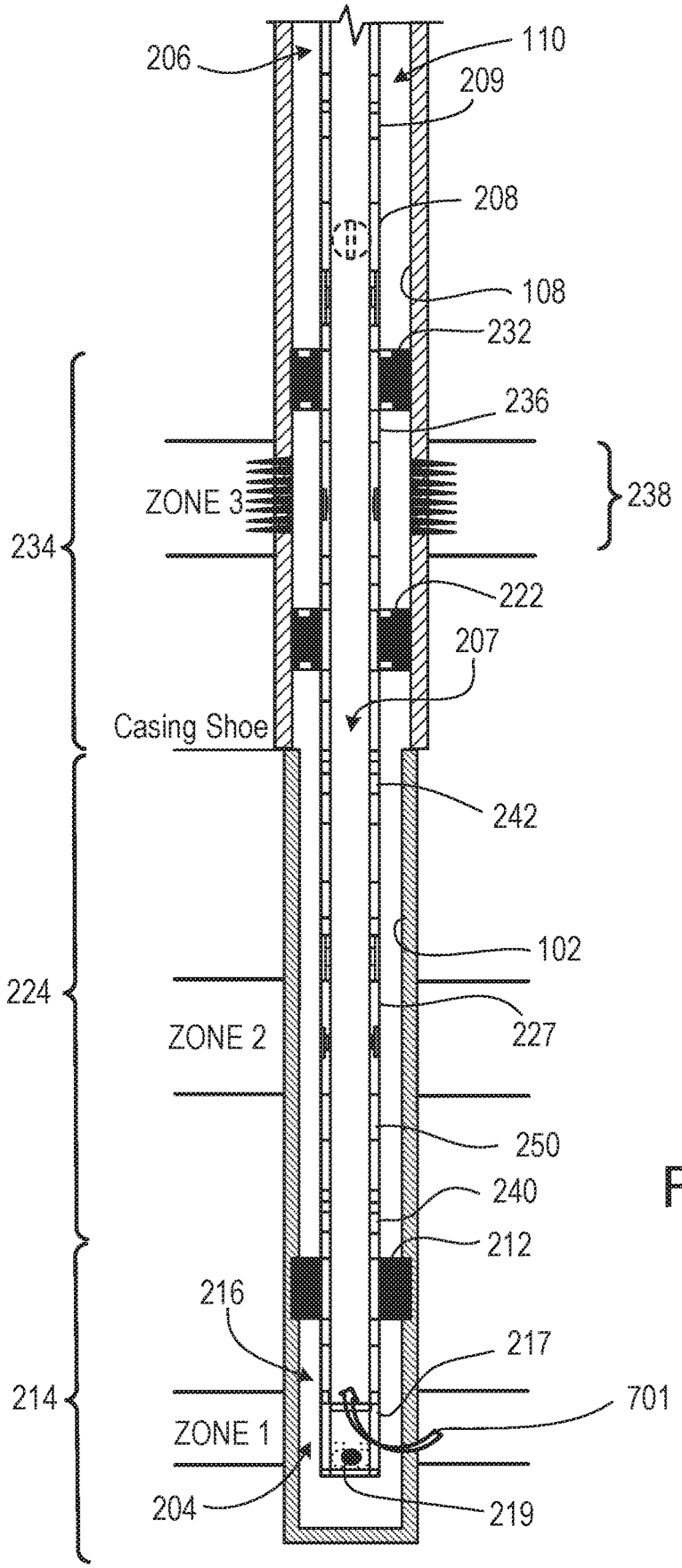
FIG. 7 is a cross sectional view of testing assembly showing a flow path from a lower zone in an open hole, down hole of the open hole packer.

With the open hole packer 212 activated and in an expanded, sealed position, the central bore can receive well fluid from the wellbore 102 downhole of the open hole packer 212 through a fluid circulation port or pre-perforated component, fluidly connecting well fluid in the annulus of the wellbore 102 with the central bore downhole of the open hole packer 212. The fluid circulation port includes an aperture through the cylindrical body at a location downhole of the open hole packer 212. In some examples, the fluid circulation port can selectively open and close, for example, in response to a pressure in the central bore, a mechanical activation, an acoustic activation, or other. In the example well testing system in FIG. 2, the circulation ports are in the form of a pre-perforated joint. The formation fluid will flow into the central bore once the sealing element 212 is sealing wellbore downhole of 212 and fluid column in the central wellbore is displaced to lighter fluid as shown in FIG. 7. In some implementations, the first open hole zone 214 includes a perforated zone including a first set of perforations 218 in the wellbore 102 extending into the formation to induce formation fluid flow from the lower open hole zone 214 into the wellbore 102.

The example testing assembly 200 also includes a first cased hole sub-assembly 220 positioned uphole of the open hole packer 212 and at least partially adjacent to the casing 108 of the wellbore 102. The first cased hole sub-assembly 220 includes a first cased hole packer 222 that circumscribes the cylindrical body 202, for example, proximate to a downhole end of the casing 108. In some examples, the first cased hole packer 222 is positioned adjacent to a casing shoe of the casing 108. The first cased hole packer 222 engages and seals against a first portion of the casing 108 to define a second, upper open-hole zone 224 of the wellbore 102 between the first cased hole packer 222 and the open hole packer 212. The first cased hole packer 222 isolates fluid in the wellbore 102 downhole of the first cased hole packer 222, for example, between the open hole packer 212 and the first cased hole packer 222.

The first cased hole packer 222 of the example testing assembly 200 of FIG. 2 includes a hydraulic packer that activates (for example, actuates, swells, or otherwise radially expands) in response to a pressure in the central bore that is greater than a second threshold pressure. However, the first cased hole packer 222 can take other forms. For example, the first cased hole packer 222 can include a mechanical packer, hydraulic packer, swellable packer, or other packer type. In some implementations, the sealing assembly 216 described earlier fluidly seals the central bore to pressure-up the central bore to the second threshold pressure to activate the first cased hole packer 222. Pressuring up the wellbore 102 with the sealing assembly 216 can be performed to set the open hole packer 212 and the first cased hole packer 222 simultaneously (for example, if the first threshold pressure and the second threshold pressure are the same), or subsequently (for example, if the first threshold pressure is different than the second threshold pressure).

In some examples, the second threshold pressure is greater than the first threshold pressure such that the open hole packer 212 is set first, followed by setting of the first cased hole packer 222. In certain implementations, the first cased hole sub-assembly 220 includes a second sealing assembly 226, similar to the sealing assembly 216 described earlier, except the second sealing assembly 226 is located uphole of the sealing assembly 216 proximate to the first cased hole packer 222. The second sealing assembly 226 can pressure-seal the central bore to activate the first cased hole packer 222; however, the second seal assembly 226 can be excluded, for example, if the first sealing assembly 216 is used to set both the open hole packer 212 and the first cased hole packer 222.

With the first cased hole packer 222 activated and in an expanded, sealed position with the first portion of the casing 108, the central bore can receive well fluid from the wellbore 107 downhole of the open hole packer 212 through a circulation port fluidly connecting well fluid in the annulus of the wellbore 107 with the central bore downhole of the open hole packer 212. The second fluid circulation port includes an aperture in the cylindrical body 202 within the second, lower open hole zone 214 of the wellbore 107. The fluid circulation port can be formed in a sliding sleeve or a sleeve valve that can selectively open or close, a spring loaded valve, a combination of these or another form. In this example it is shown as pre-perforated component.

FIGS. 2 and 4 show the second circulation port in a pup joint 227 of the cylindrical body 202, but the second fluid circulation port can take a variety of other forms. For example, the second fluid circulation port can be formed in a sleeve valve or sliding sleeve that can selectively open and close, a spring-loaded valve opening, an opening in the cylindrical body 202, a combination of these, or another form. In some instances, the second fluid circulation port is not formed in the testing assembly 200 prior to disposing the testing assembly 200 downhole in the wellbore 102. In these instances, a perforation gun can be lowered into the central bore, for example, on a wire line, slick line, or other line, and positioned downhole of the first cased hole packer 222. In the example testing assembly of FIGS. 2 and 4, the perforation gun can be lowered in the central bore and positioned adjacent to the pup joint 227, where the perforation gun perforates the pup joint 227 to create the second fluid circulation port. The perforation gun can subsequently be removed from the central bore after perforating the pup joint 227 to allow well fluid to flow from the second, upper open hole zone 224 into the central bore.

In some implementations, the second, upper open hole zone 224 includes a perforated zone including a second set of perforations 228 in the wellbore 102 extending into the formation to induce formation fluid flow into the wellbore 102. The second set of perforations 228 can be pre-perforated prior to disposing the testing assembly 200 in the wellbore 102, or the second set of perforations 228 can be formed while the testing assembly 200 is disposed in the wellbore 102. For example, a perforation gun, such as the perforation gun described earlier with respect to the second fluid circulation port, can be lowered into the central bore and positioned downhole of the first cased hole packer 222 to create the second set of perforations 228 extending into the formation of the second, upper open hole zone 224.

Slip joints are telescopic components in the testing assembly, which help to accommodate tubing movement or length changes as the well flows during well testing process. The joints maintain a hydraulic seal between the tubing conduit and the annulus even with vertical movement of the tubing during well testing operations. Testing assembly also includes downhole gauges, which are run in gauge carrier. The gauges record the downhole pressure while the well is being flow tested. The data in memory is retrieved after pulling the testing assembly out of the well and is used for reservoir pressure and reservoir potential assessment. Swivel allows rotation of the string without transferring torque to the string below it. Swivel is required if second cased hole packer requires to be set mechanically with string rotation after setting the first cased hole packer.

The example testing assembly 200 also includes a second cased hole sub-assembly 230 positioned uphole of the first cased hole sub-assembly 220 and positioned adjacent to the casing 108 of the wellbore. The second cased hole sub-assembly 230 includes a second cased hole packer 232 that circumscribes the cylindrical body 202. The second cased hole packer 232 engages and seals against a second portion of the casing 108 uphole of the first cased hole sub-assembly 220 to define a cased hole zone 234 of the wellbore 102 between the first cased hole packer 222 and the second cased hole packer 232. The second cased hole packer 232 isolates fluid in the wellbore 102 downhole of the second cased hole packer 232, for example, between the first cased hole packer 222 and the second cased hole packer 232. The second cased hole packer 232 of the example testing assembly 200 of FIG. 2 includes a mechanical packer that activates (for example, actuates, swells, or otherwise radially expands) in response to a rotation of the cylindrical body 202. However, the second cased hole packer 232 can take other forms. For example, the second cased hole packer 222 can include a mechanical packer, hydraulic packer, swellable packer, or other packer type.

The second cased hole sub-assembly 230 of the example testing assembly 200 includes a sleeve valve 236 in the cylindrical body 202 positioned between the second cased hole packer 232 and the first cased hole packer 222 to selectively open a third circulation port (not shown) that fluidly connects well fluid in the cased hole zone 234 with the central bore of the cylindrical body 202. The third fluid circulation port includes an aperture in the cylindrical body 202 within the cased hole zone 234 of the wellbore 102, and the sleeve valve can be activated to open the third fluid circulation port to flow fluid. The sleeve valve 236 can take many forms and be activated in many ways. For example, the sleeve valve 236 can include a sliding sleeve, spring-loaded sleeve, or other sleeve type, and can be activated mechanically, acoustically, hydraulically, or another way.

FIGS. 2 and 4 show the third circulation port formed in the cylindrical body 202 and selectively opened and closed by the sleeve valve 236, but the third fluid circulation port can take a variety of other forms fluidly connecting the well fluid in the wellbore 102 with the central bore of the testing assembly 200. For example, the sleeve valve 236 may be excluded and the third circulation port can be formed in a wall of the cylindrical body 202 within the cased hole zone 234. With the second cased hole packer 232 activated and in an expanded, sealed position, the sleeve valve 236 can be activated to open the third circulation port and receive well fluid from the wellbore 102 downhole of the second cased hole packer 232 through the third circulation port fluidly connecting well fluid in the annulus of the wellbore 102 with the central bore downhole of the second cased hole packer 232.

In some implementations, the cased hole zone 234 includes a perforated zone including a third set of perforations 238 in the wellbore 102 extending through the casing and into the formation to induce formation fluid flow into the wellbore 102. The third set of perforations 238 can be pre-perforated prior to disposing the testing assembly 200 in the wellbore 102, or the third set of perforations 238 can be formed while the testing assembly 200 is disposed in the wellbore 102. For example, a perforating gun can be lowered into the central bore, for example, on a wireline, slick line, or other line, and positioned downhole of the second cased hole packer 232 to create the third set of perforations 238.

In some implementations, the testing assembly 200 includes a first seal structure 240 positioned between the open hole packer 212 and the first cased hole packer 222 to selectively engage with a first plug element and seal the central bore at the first seal structure 240. FIG. 2 shows the first seal structure 240 as including a nipple, where the first plug element includes a plug and prong. However, the first seal structure 240 and the first plug element can take a variety of forms.

For example, the first seal structure 240 can include a ball seat, plug seat, or another seal structure, and the first plug element can include a plug, prong, dropped ball, a combination of these, or another plug element. The first seal structure 240, when engaged with the first plug element, isolates the central bore from well fluid from the first, lower open hole zone 214 such that well fluid from the first open hole zone 214 is plugged from flowing uphole through the central bore uphole of the first seal structure 240. The first seal structure 240 allows for fluid flow and testing of well fluid from the second open hole zone 224, the cased hole zone 234, or both the second open hole zone 224 and the cased hole zone 234 without infiltration of well fluid from the first open hole zone 214.

In certain implementations, the testing assembly 200 includes a second seal structure 242 positioned between the first cased hole packer 222 and the second cased hole packer 232 to selectively engage with a second plug element and seal the central bore at the second seal structure 242. The second seal structure 242 can be similar to the first seal structure 240, but is positioned in the cylindrical body 202 at a different location along the central bore. Similarly, the second plug element can be similar to the first plug element.

FIGS. 2 and 4 show the second seal structure 242 as including a nipple, where the second plug element includes a plug and prong. However, similar to the first seal structure 240 and first plug element, the second seal structure 242 and second plug element can take a variety of forms. The second seal structure 242, when engaged with the second plug element, isolates the central bore from well fluid from the first, lower open hole zone 214, the second, upper open hole zone 224, or both the first open hole zone 214 and the second open hole zone 224 such that well fluid from the first open hole zone 214 and the second open hole zone 224 is plugged from flowing uphole through the central bore uphole of the second seal structure 242. The second seal structure 242 allows for fluid flow and testing of well fluid from the cased hole zone 234 without infiltration of well fluid from the first open hole zone 214, the second open hole zone 224, or both the first open hole zone 214 and the second open hole zone 224.

In some implementations, at least part of the testing assembly 200 is sacrificial. A portion of the testing assembly 200 can be left in the wellbore 102, for example, if one or more packers (such as open hole packer 212, first cased hole packer 222, second cased hole packer 232, or a combination of these) of the testing assembly 200 become stuck in the wellbore 102. In the example testing assembly 200 of FIG. 2, the cylindrical body 202 includes a first release joint 250 in the cylindrical body 202 between the open hole packer 212 and the first cased hole packer 222 and a second release joint 252 between the first cased hole packer 222 and the second cased hole packer 232. Each of the release joints 250 and 252, when activated, disconnect the cylindrical body 202 at the respective release joint, for example, to sacrifice the portion of the testing assembly 200 downhole of the respective release joint. For example, when the first release joint 250 is activated, the open hole sub-assembly 210 is sacrificed, for example, left downhole while the portion of the testing assembly 200 uphole of the first release joint 250 can be removed from the wellbore 102.

In some examples, when the second release joint 252 is activated, the open hole sub-assembly 210 and the first cased hole sub-assembly 220 is sacrificed, for example, left downhole while the portion of the testing assembly 200 uphole of the second release joint 250 can be removed from the wellbore 102. While the example testing assembly 200 includes two release joints 250 and 252, the number and location of the release joints can be different. For example, the testing assembly 200 can include one, two, three, or more release joints distributed along the cylindrical body 202. The first release joint 250 and the second release joint 252 can take a variety of forms.

In some examples, the release joints 250 and 252 can include a hydraulic release, a safety joint, a combination of these, or another release joint type. For example, FIG. 2 shows the first release joint 250 as including a hydraulic release, and the second release joint as including a safety joint. In some implementations, a third release joint is positioned uphole of the second cased hole packer 232, for example, to sacrifice the second cased hole sub-assembly 230 and the remaining portions of the testing assembly 200 downhole of the second cased hole sub-assembly 230.

The testing assembly 200 of FIGS. 2 and 4 can be used to test multiple zones of the wellbore 102, such as the first open hole zone 214, second open hole zone 224, and the cased hole zone 234, in a single run-in of the testing assembly 200. The testing assembly 200 can include additional cased hole packers, additional open hole packers, or both, for example, if more wellbore zones are desired to be tested. For example, the example testing assembly includes two cased hole packers and one open hole packer, but the number of cased hole packers and open hole packers can be different, such as two, three, or more open hole packers, and 2, 3, or more cased hole packers. An example testing method utilizing the testing assembly 200 is described later, which includes a number of process steps that combine testing of cased hole and open hole wellbore zones in one run.

The casing 108 is run into the wellbore 102 prior to penetration of hydrocarbon reservoirs in the well. The open hole section of the wellbore 102 can be drilled as a slim hole, for example, with a 5⅞" diameter, across a primary reservoir target intended for assessment and testing. However, other diameters and open hole types can be formed for well testing. In some examples, a slim hole provides favorable conditions for open hole packers (for example, open hole packer 212) to handle higher differential pressures in the wellbore 102. After the open hole section of the wellbore 102 is drilled to a target depth, logs can be run as needed to evaluate the zones of interest (for example, zones of interest 106 and 107) and identify any washed out parts of the open hole.

In some instances, a target zone in the cased hole zone 234 is perforated under overbalance conditions with casing guns. For example, the third set of perforations 238 can be created in the cased hole zone 234 prior to disposing the testing assembly 200 in the wellbore 102 and while the well is overbalanced, so the third set of perforations 238 may not naturally flow formation fluid into the wellbore 102. In certain instances, this step of perforating the cased hole zone 234 can be skipped and the third set of perforations 238 need not be created if the cased hole zone 234 is not to be tested.

In some instances, the testing assembly 200 is run in the wellbore 102 on a predesigned tubing string. The open hole packer 212 is positioned between two zones of interest (for example, between subterranean zones of interest 106 and 107) across a gauged hole section as identified by open hole logs. The first cased hole packer 222 is positioned inside the casing shoe and the second cased hole packer 232 is positioned just uphole of the pre-perforated zone (for example, just uphole of the third set of perforations 238). The open hole packer 212, first cased hole packer 222, and the second cased hole packer 232 can be set in the wellbore 102 in a variety of ways, as described earlier. For example, the open hole packer 212 and the first, lower cased hole packer 222 can be set through hydraulic pressure internal to the central bore, whereas the second, upper cased hole packer 232 can be set by mechanical movement of the well string 110. Once the open hole packer 212, first cased hole packer 222, and second cased hole packer 232 are set, the testing assembly 200 can be pressure tested and drifted to ensure proper installment and accessibility of intervention tools described in later process steps.

In some examples, one or both of the open hole zones 214 and 224 include carbonate, which may require an acidizing step. In these examples, the testing assembly 200 can circulate and spot acid across one or both of the open hole zones 214 and 224 before setting the open hole packer 212. As described earlier, to set the open hole packer 212, a plug element 219 (for example, a drop ball) is dropped to sit in and engage the sealing assembly 216 (for example, a plug seat) located downhole of the open hole packer 212, and the central bore is pressured up to set the open hole packer 212. An operator can slack off weight on the well string 110 to confirm that the open hole packer 212 is set, then further increase the pressure in the central bore to set the first, lower cased hole packer 222.

The internal pressure in the central bore can continue to increase to blow the sealing assembly 216 (for example, the plug seat or ball seat) and the plug element 219 (for example, the dropped ball) to move into the ball catcher 217 below the open hole packer 212. An operator can further slack off weight of the well string 110 and rotate the well string 110 to mechanically set the second, upper cased hole packer 232. The annulus of the wellbore 102, the central bore, or both the annulus and the central bore can be pressured up to confirm the open hole packer 212, first cased hole packer 222, and second cased hole packer 232 are set. For example, the annulus can be pressured up to 500 psi to confirm proper hold of the packers.

In some instances, well fluid from the first, lower open hole zone 214 can be circulated in the central bore of the testing assembly 200. For example, a circulation valve 209 above the second, upper cased hole packer 232 is opened and a lighter cushion fluid is circulated inside the central bore. The circulation valve 209 can then be closed and well fluid from the lower open hole zone 214 can flow through the testing assembly 200 for well test measurements of the lower open hole zone 214. If the lower open hole zone 214 does not flow naturally, the circulating port can be opened and a nitrogen cushion can be added to the central bore to promote well fluid flow, or the well string can be rigged to lift the well, among other well flow boosting techniques.

In some instances, the lower open hole zone 214 can be isolated for conclusive measurement of the upper open hole zone 224, for example, if the lower open hole zone 214 flows water or another unwanted fluid. In some examples, a plug element, such as a plug and prong, can be dropped or lowered into the central bore to engage the seal structure 240, such as a nipple above open hole packer 212. This plug element can engage the seal structure 240 and isolate well fluid from the lower open hole zone 214 from flowing uphole through the central bore of the testing assembly 200. However, if isolation of the lower open hole zone 214 is not required, this step can be skipped.

In some instances, the cylindrical body 202 does not include the second circulation port between the open hole packer 212 and the first cased hole packer 222 to allow fluid to flow from the upper open hole zone 224 into the central bore of the testing assembly 200. To create the second circulation port between the open hole packer 212 and the first cased hole packer 222, a perforation gun can be run in on a wireline, slick line, or other line through the central bore and positioned in the central bore within the second, upper open hole zone 224. In some examples, the perforation gun is positioned adjacent to the pup joint 227 in the cylindrical body 202 to perforate the pup joint 227, thus fluidly connecting the well fluid in the second, upper open hole zone 224 with the central bore of the testing assembly 200. The perforation gun can optionally perforate the open hole surface of the wellbore to create the second set of perforations 228; however, the perforation gun primarily perforates the cylindrical body 202, for example, at the pup joint 227, to create the second circulation port and a flow path for formation fluid to flow from the upper open hole zone 224 into the central bore. Well fluid from the upper open hole zone 224 flows uphole through the central bore for conclusively testing and measuring the well fluid. Optionally, after completing all well fluid testing and measurements from the upper open hole zone 224, the plug element engaged with the seal structure 240 can be removed from the seal structure 240, for example, with a wireline, slick line, or other line.

In some instances, when the lower open hole zone 214 and the upper open hole zone 224 flow hydrocarbon and there is no preference to isolate the lower open hole zone 214, a production log can be run inside the testing assembly 200 on a wireline to independently measure well fluid flow from each zone in the open hole portion of the wellbore 102.

In some instances, once the open hole zones of the wellbore 102 have completed testing, the open hole portion of the wellbore 102 can be killed. For example, a kill weight fluid can be pumped through the central bore and into the wellbore 102 and formation at the first, lower open hole zone 214 and the second, upper open hole zone 224, culminating the testing of the potential zones in the open hole portion of the wellbore 102.

In some instances, the open hole zones of the wellbore 102 can be isolated, for example, to test the cased hole zone 234 of the wellbore 102. In some examples, a plug element, such as a plug and prong, can be dropped or lowered into the central bore to engage the seal structure 242, such as a nipple above the first cased hole packer 222. This plug element can engage the seal structure 242 and isolate well fluid from the lower open hole zone 214 and the upper open hole zone 214 from flowing uphole through the central bore of the testing assembly 200. The central bore can be pressure tested to ensure a pressure seal at the seal structure 242 and isolation of the open hole zones, and can be negative tested by circulating lighter fluid through the circulation valve 209, if desired for confirmation that future flow tests will not have any infiltration from the open hole test zones. At the completion of the negative testing, kill weight fluid can be provided to the formation through the central bore.

In some instances, testing the cased hole zone 234 includes opening the sleeve valve 236 (for example, a sliding sleeve) across the pre-perforated zone (for example, the third set of perforations 238). The sleeve valve 236 can be opened mechanically, acoustically, or another way. In some examples, the circulation valve 209 can be opened to displace lighter fluid into the central bore as cushion. Well fluid from the third cased zone 234 is directed to the testing element 208, such as a choke manifold, to measure parameters for testing the cased hole zone 234. If well fluid in the cased hole zone 234 does not flow naturally, the circulating port can be opened to provide a nitrogen cushion to boost well fluid flow. After completing all testing and flow measurements of the cased hole zone 234, the well can be killed by pumping a kill weight fluid into the formation. In some examples, to complete removal of formation fluid from the wellbore 102, a reverse circulation step is performed through a packer by-pass port.

After completing testing of all zones of the wellbore 102, the plug element engaged with the seal structure 242 can be retrieved with a slick line, wireline, or other line, and the second cased hole packer 232 and the first cased hole packer 222 are unset by pulling uphole on the testing assembly 200 via the well string. Continuing to pull on the testing assembly 200 can retrieve the open hole packer 212. In certain instances, the open hole packer 212 may be stuck in the wellbore 102, for example, due to solids settling or the open hole collapsing during testing. The open hole packer 212 can be sacrificed by activating the release joint 250 and leaving the open hole packer 212 in the wellbore 102 while retrieving the uphole remainder of the testing assembly 200.

Figure 3:
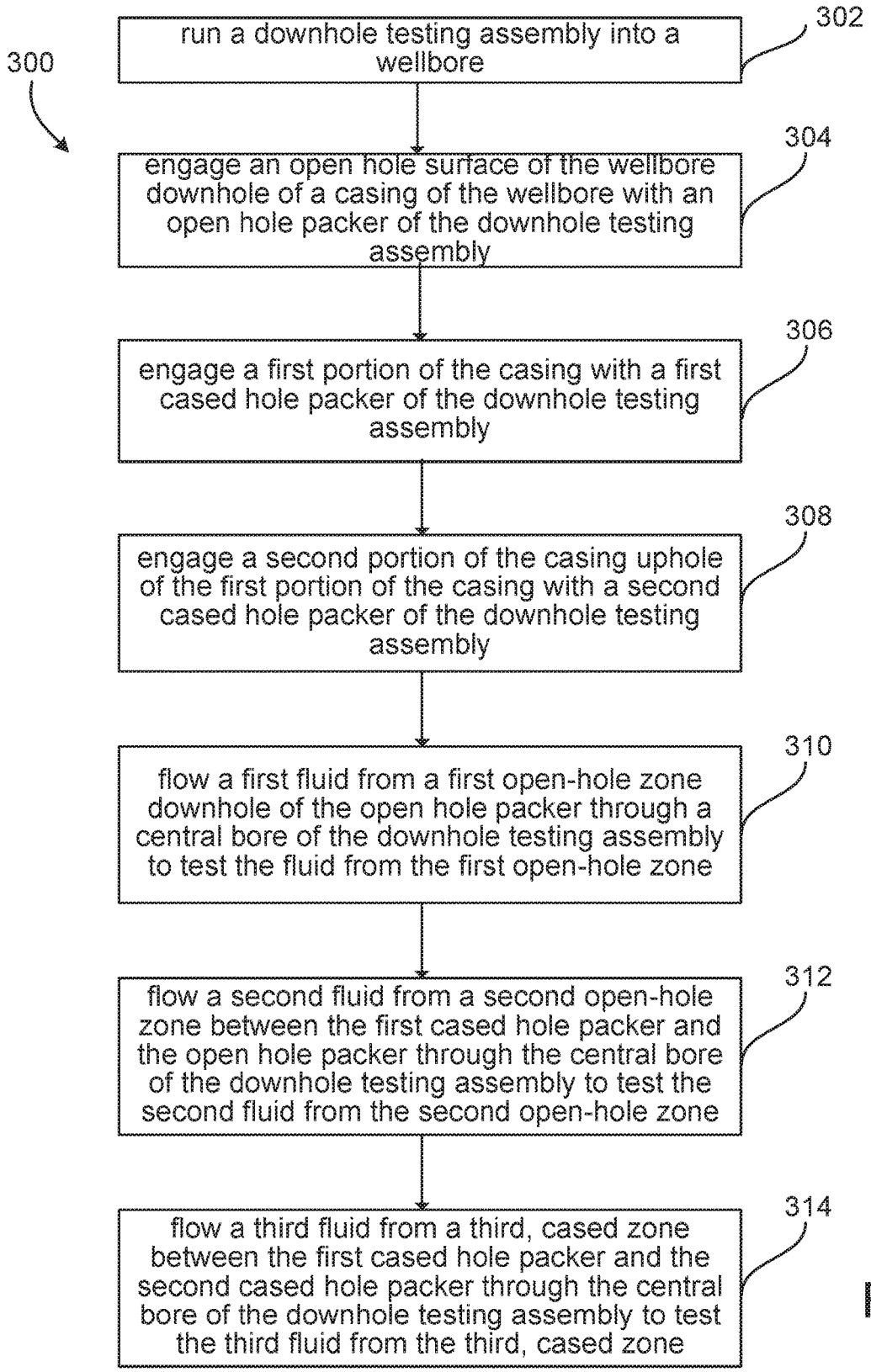
FIG. 3 is a flowchart describing an example method for testing fluid in a wellbore.
Figure 5:
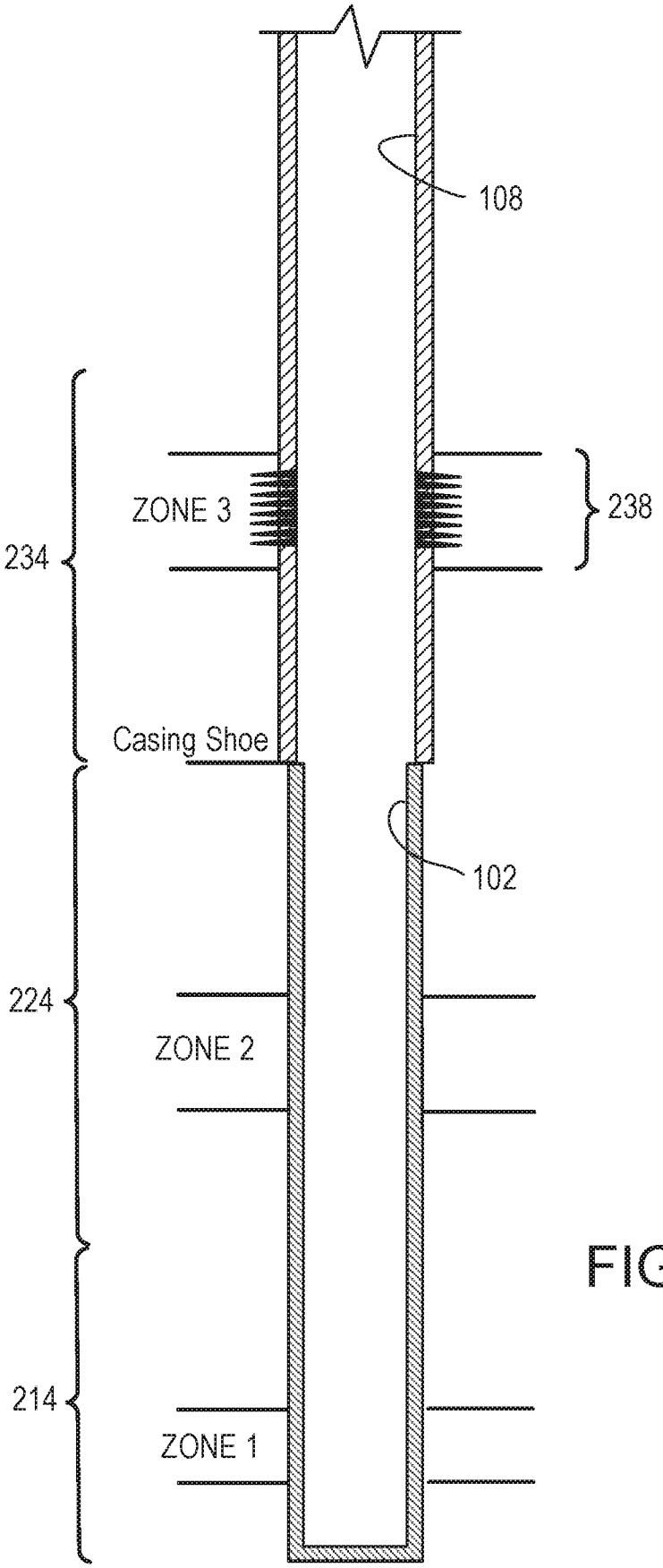
FIG. 5 is a cross sectional view of the well with overbalance perforations across a cased hole test zone prior to running the testing assembly in the well.
Figure 6:
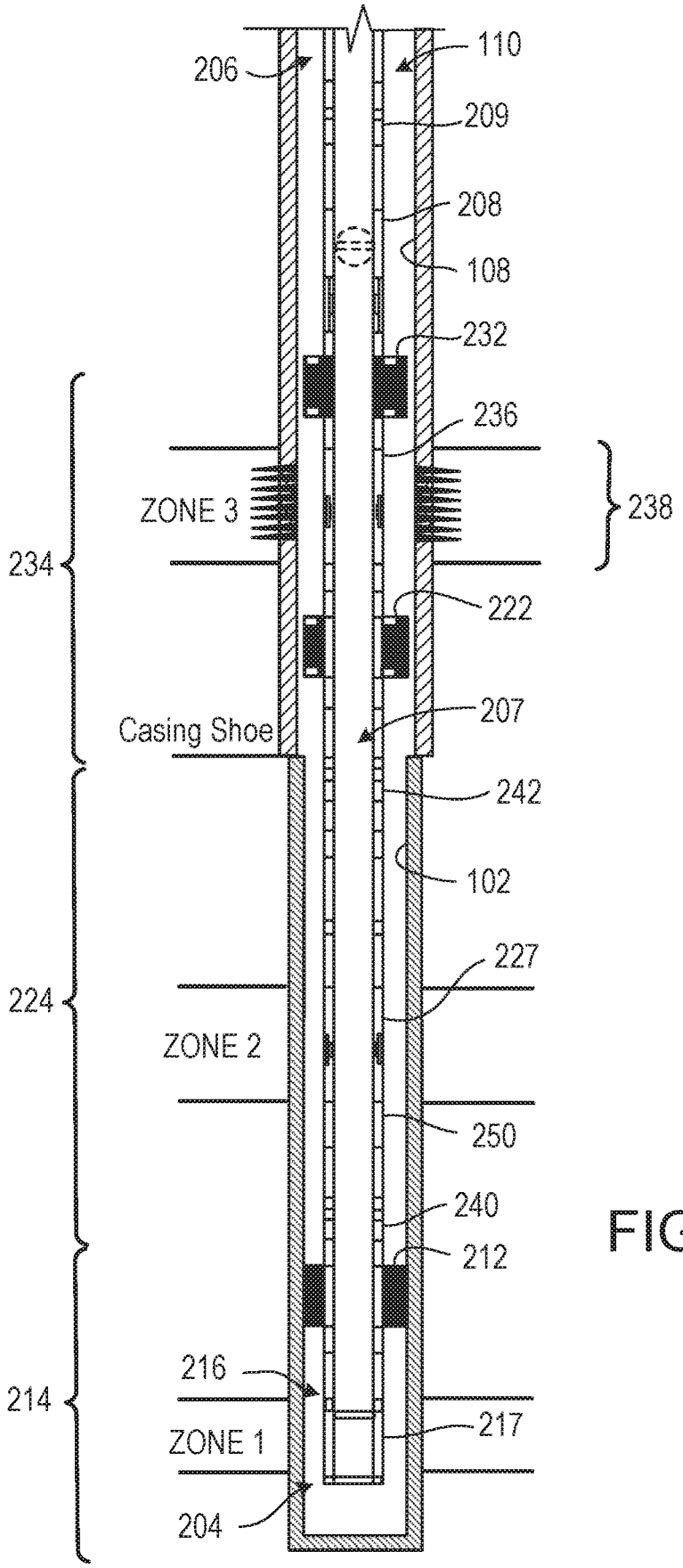
FIG. 6 is a cross sectional view of the testing assembly positioned in a wellbore.

FIG. 3 is a flowchart describing an example method 300 for testing fluid in a wellbore, for example, performed by the example testing assembly 200 of FIGS. 2 and 4 in wellbore 102. At 302, a downhole testing assembly is run into a wellbore. Turning briefly to FIG. 5, this figure illustrates a cross sectional view of the well with overbalance perforations across a cased hole test zone 234 prior to running the testing assembly 200 in the well. As shown, casing 108 extend from an uphole end of the wellbore 102 to a casing shoe. The second, upper open-hole zone 224 is located downhole of the casing shoe, as is the first open hole zone 214. As next shown in FIG. 6, the testing assembly 200 is run into the wellbore 102 with the open hole packer 212 and the first and second cased hole packers 222 and 232 in an unactuated state (for example, unswelled).

At 304, an open hole packer of the downhole testing assembly engages an open hole surface of the wellbore downhole of a casing 108 of the wellbore 102. As further shown in FIG. 6, once positioned in the wellbore 102, the open hole packer 212 is actuated (for example, swelled) to contactingly engage the open hole wellbore 102. Thus, an annulus of the wellbore 102 is sealed between the open hole zone 214 and the first, cased hole zone 224, with only the fluid pathway 207 allowing communication between these two zones.

At 306, a first cased hole packer of the downhole testing assembly engages a first portion of the casing. Turning next to FIG. 7, the first cased hole packer 222 is actuated to contactingly engage the casing 108 in the wellbore 102. Thus, the annulus of the wellbore 102 is sealed between the first, cased hole zone 224 and the second, cased hole zone 234, with only the fluid pathway 207 allowing communication between these two zones.

At 308, a second cased hole packer of the downhole testing assembly engages a second portion of the casing uphole of the first portion of the casing. Continuing with FIG. 7, the second cased hole packer 232 is actuated to contactingly engage the casing 108 in the wellbore 102. Thus, the annulus of the wellbore 102 is sealed between the second, cased hole zone 234 and the annulus uphole of the packer 232, with only the fluid pathway 207 allowing communication between these two zones.

At 310, a first fluid flows from a first open-hole zone downhole of the open hole packer through a central bore of the downhole testing assembly to test the fluid from the first open hole zone. Continuing with FIG. 7, the first fluid (labeled 701) flows into the fluid pathway 207 (for example, once the sealing element 219 drops to break the sealing element 217 and fall into the seat 217.

Figure 8:
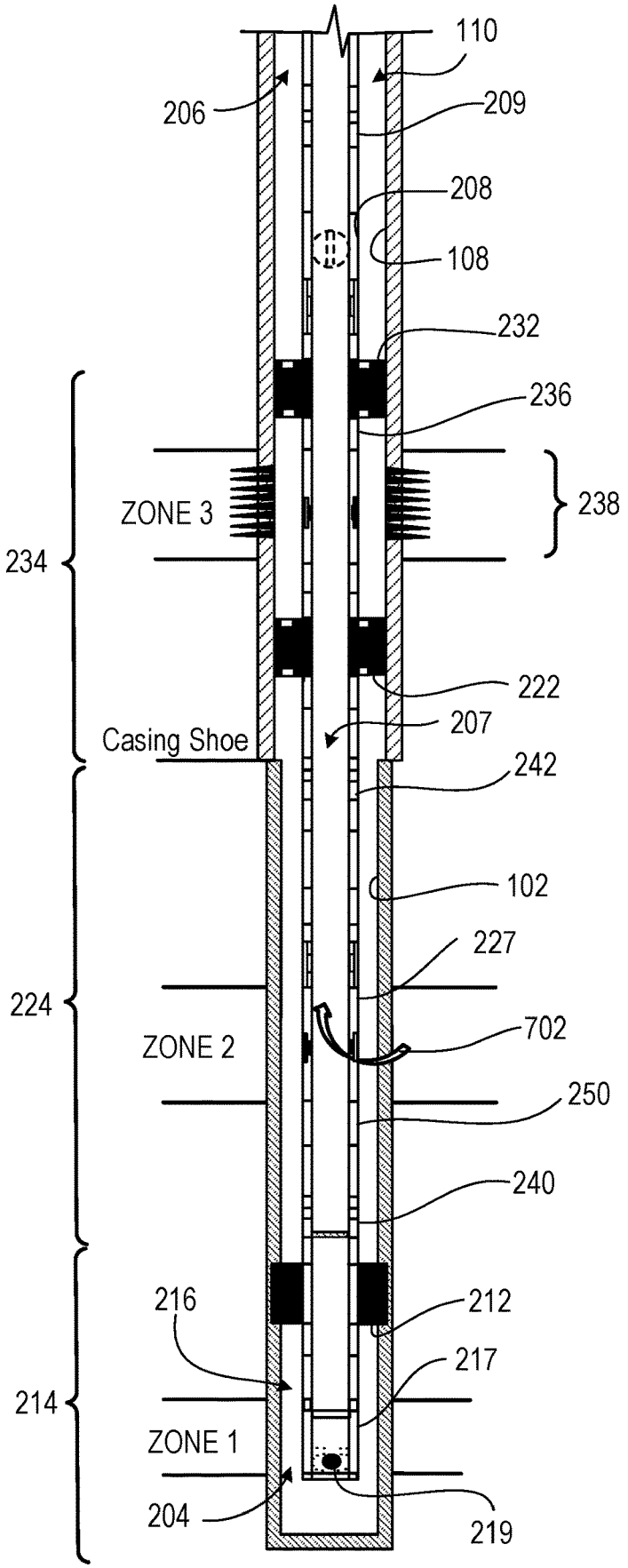
FIG. 8 is a cross sectional view of testing assembly showing a flow path from an upper zone in an open hole, down hole of the first cased hole packer and up hole of the open hole packer.

At 312, a second fluid flows from a second open-hole zone between the first cased hole packer and the open hole packer through the central bore to test the second fluid from the second open-hole zone. For example, turning to FIG. 8, the second fluid (labeled 702) flows into the fluid pathway 207 from the formation once the first seal structure 240 is actuated to seal the pathway 207 downhole of the second circulation port in the pup joint 227.

Figure 9:
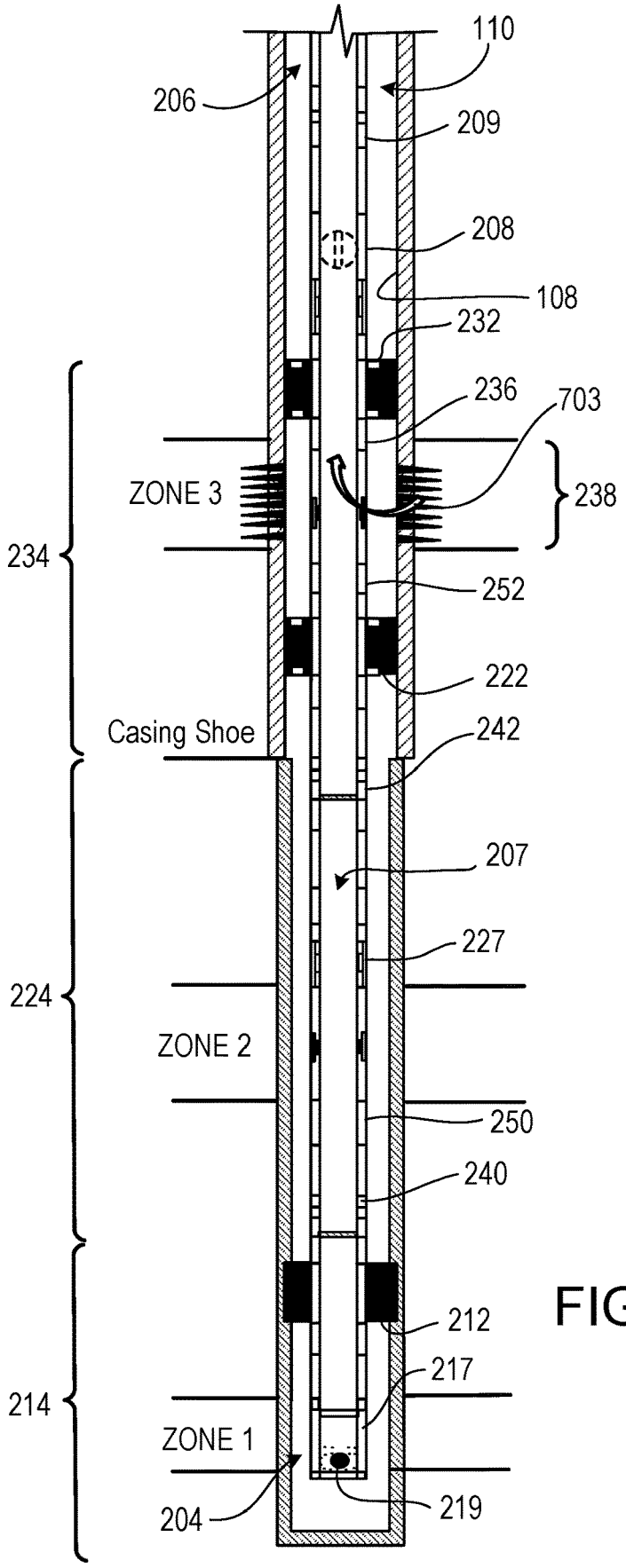
FIG. 9 is a cross sectional view of testing assembly showing a flow path from a zone in a cased hole, down hole of second cased hole packer and up hole of the first cased hole packer.

At 314, a third fluid flows from a third, cased zone between the first cased hole packer and the second cased hole packer through the central bore to test the third fluid from the third, cased zone. For example, turning to FIG. 9, the third fluid (labeled 703) flows into the fluid pathway 207 from the formation once the second seal structure 242 is actuated to seal the pathway 207 downhole of the second release joint 252.

A number of implementations have been described. Nevertheless, it will be understood that various modifications may be made without departing from the spirit and scope of the disclosure.

What is claimed is:

1. A downhole testing assembly, comprising:

a cylindrical body configured to be disposed in a wellbore extending into a formation, the cylindrical body comprising a central bore extending between a first, uphole end of the cylindrical body and a second, downhole end opposite the first, uphole end of the cylindrical body;

an open hole packer that circumscribes the cylindrical body, the open hole packer configured to engage and seal against an open hole surface of the wellbore to define a first open-hole zone of the wellbore downhole of the open hole packer, the open hole packer comprising a first hydraulic packer configured to activate in response to a pressure in the central bore greater than a first threshold pressure;

a first cased hole packer that circumscribes the cylindrical body uphole of the open hole packer, the first cased hole packer configured to engage and seal against a first portion of a casing of the wellbore to define a second open-hole zone of the wellbore between the first cased hole packer and the open hole packer, the first cased hole packer comprising a second hydraulic packer configured to activate in response to a pressure in the central bore greater than a second threshold pressure that is greater than or equal to the first threshold pressure; and a second cased hole packer that circumscribes the cylindrical body, the second cased hole packer configured to engage and seal against a second portion of the casing uphole of the first portion to define a cased zone of the wellbore between the second cased hole packer and the first cased hole packer.

2. The downhole testing assembly of claim 1, further comprising a sleeve valve in the cylindrical body positioned between the second cased hole packer and the first cased hole packer, the sleeve valve configured to selectively open a circulation port that fluidly connects well fluid in the cased zone with the central bore of the cylindrical body.

3. The downhole testing assembly of claim 2, wherein the circulation port comprises a first circulation port, the assembly further comprising a second circulation port positioned between the open hole packer and the downhole end of the cylindrical body, the second circulation port configured to selectively open to fluidly couple the central bore with the first open-hole zone.

4. The downhole testing assembly of claim 1, wherein the second cased hole packer is positioned uphole of a perforated zone of the casing.

5. The downhole testing assembly of claim 1, wherein the open hole packer is positioned proximate to the downhole end of the cylindrical body.

6. The downhole testing assembly of claim 1, wherein the first cased hole packer is positioned proximate to a downhole end of the casing.

7. The downhole testing assembly of claim 6, wherein the second cased hole packer is positioned uphole of the first cased hole packer.

8. The downhole testing assembly of claim 1, wherein the second cased hole packer is configured to activate in response to rotation of the cylindrical body.

9. The downhole testing assembly of claim 8, wherein the second cased hole packer comprises a mechanical packer.

10. The downhole testing assembly of claim 1, further comprising a release joint in the cylindrical body between the first cased hole packer and the open hole packer, the release joint configured to disconnect the cylindrical body at the release joint.

11. The downhole testing assembly of claim 1, further comprising a first seal structure positioned between the open hole packer and the first cased hole packer, the first seal structure configured to selectively engage with a first plug element and isolate the central bore from well fluid from the first open-hole zone.

12. The downhole testing assembly of claim 11, further comprising a second seal structure positioned between the first cased hole packer and the second cased hole packer, the second seal structure configured to selectively engage with a second plug element and isolate the central bore from well fluid from at least one of the second open-hole zone or the first open-hole zone.

13. The downhole testing assembly of claim 1, wherein the second hydraulic packer is configured to activate, subsequent to activation of the open hole packer, in response to the pressure in the central bore greater than the second threshold pressure that is greater than the first threshold pressure.

14. A method for testing fluid in a wellbore, comprising:

running a downhole testing assembly into a wellbore;

engaging, with an open hole packer of the downhole testing assembly, an open hole surface of the wellbore downhole of a casing of the wellbore, where engaging the open hole surface of the wellbore downhole of the casing with the open hole packer comprises sealingly engaging a plug on a plug seat within the central bore of the downhole testing assembly and expanding the open hole packer to engage the open hole surface in response to a pressure within the central bore that is greater than a first threshold pressure;

engaging, with a first cased hole packer of the downhole testing assembly, a first portion of the casing, where engaging the first portion of the casing of the wellbore with the first cased hole packer comprises expanding the first cased hole packer to engage the first portion of the casing in response to a pressure within the central bore that is greater than a second threshold pressure that is greater than or equal to the first threshold pressure;

engaging, with a second cased hole packer of the downhole testing assembly, a second portion of the casing uphole of the first portion of the casing;

flowing a first fluid from a first open-hole zone downhole of the open hole packer through a central bore of the downhole testing assembly to test the first fluid from the first open-hole zone;

flowing a second fluid from a second open-hole zone between the first cased hole packer and the open hole packer through the central bore of the downhole testing assembly to test the second fluid from the second open-hole zone; and flowing a third fluid from a third, cased zone between the first cased hole packer and the second cased hole packer through the central bore of the downhole testing assembly to test the third fluid from the third, cased zone.

15. The method of claim 14, wherein the first cased hole packer engaged with the first portion of the casing of the wellbore is proximate to a downhole end of the casing.

16. The method of claim 15, wherein the first cased hole packer is positioned adjacent to a casing shoe of the casing.

17. The method of claim 15, wherein the second cased hole packer engaged with the second portion of the casing of the wellbore is positioned uphole of a perforated zone of the casing.

18. The method of claim 14, wherein the wellbore extends into a formation, and the open hole packer engaged with the open hole surface of the wellbore is positioned between a first zone of interest and a second zone of interest of the formation.

19. The method of claim 14, wherein engaging the open hole surface of the wellbore downhole of the casing with the open hole packer comprises sealing the open hole packer to the open hole surface.

20. The method of claim 14, further comprising:

subsequent to flowing the first fluid from the first open-hole zone through the central bore of the downhole testing assembly and prior to flowing the second fluid from the second open-hole zone through the central bore, sealingly engaging, with a plug element, a first sealing assembly positioned uphole of the open hole packer to isolate the central bore from the first fluid of the first open-hole zone.

21. The method of claim 20, wherein the plug element comprises at least one of a plug or a prong, and the sealing assembly comprises a plug seat.

22. The method of claim 14, wherein flowing the second fluid from the second open-hole zone through the central bore comprises flowing the second fluid from the second open-hole zone through at least one perforation in a wall of the downhole testing assembly within the second open-hole zone and into the central bore.

23. The method of claim 22, further comprising perforating, with a perforation gun on a wireline disposed within the central bore of the downhole testing assembly, the wall of the downhole testing assembly to form the at least one perforation prior to flowing the second fluid from the second open-hole zone through the central bore.

24. The method of claim 23, further comprising, prior to flowing the first fluid from the first open-hole zone downhole of the open hole packer through the central bore of the downhole testing assembly to test the first fluid from the first open-hole zone, selectively opening a circulation port positioned between the open hole packer and the downhole end of the cylindrical body to fluidly couple the central bore to the first open-hole zone.

25. The method of claim 14, further comprising, in response to flowing the second fluid from the second open-hole zone through the central bore and prior to flowing the third fluid from the third, cased zone through the central bore, sealingly engaging, with a plug element, a second sealing assembly positioned proximate to the first cased hole packer to isolate the central bore from the second fluid of the second open-hole zone and the first fluid of the first open-hole zone.

26. The method of claim 14, wherein flowing the third fluid from the third, cased zone between the first cased hole packer and the second cased hole packer through the central bore of the downhole testing assembly comprises moving a sleeve valve of the downhole testing assembly from a first, closed position to a second, open position and flowing the third fluid from the third, cased zone through a circulation port of the sleeve valve with the sleeve valve in the second, open position and through the central bore of the downhole testing assembly.

27. The method of claim 14, further comprising retrieving, with a slick line disposed in the wellbore, the downhole testing assembly.

28. The method of claim 27, wherein retrieving the downhole testing assembly comprises moving the testing assembly uphole to unset the first cased hole packer and the second cased hole packer.

29. The method of claim 28, wherein retrieving the downhole testing assembly further comprises moving the testing assembly uphole to unset the open hole packer.

30. The method of claim 28, wherein retrieving the downhole testing assembly further comprises abandoning the open hole packer in the wellbore.

31. The method of claim 14, wherein engaging the first portion of the casing of the wellbore with the first cased hole packer comprises expanding the first cased hole packer, subsequent to expanding the open hole packer to engage the open hole surface, to engage the first portion of the casing in response to the pressure within the central bore that is greater than the second threshold pressure that is greater than the first threshold pressure.

32. The method of claim 14, further comprising, prior to flowing the first fluid from the first open-hole zone downhole of the open hole packer through the central bore of the downhole testing assembly to test the first fluid from the first open-hole zone, selectively opening a circulation port positioned between the open hole packer and the downhole end of the cylindrical body to fluidly couple the central bore to the first open-hole zone.

* * * * *